US009623283B2

(12) United States Patent
Vallo et al.

(10) Patent No.: US 9,623,283 B2
(45) Date of Patent: Apr. 18, 2017

(54) EXERCISE ROLLER DEVICE WITH REMOVABLY FIXABLE SUPPORT

(71) Applicant: Omavalmentaja Kajaani Oy, Kajaani (FI)

(72) Inventors: Pekka Vallo, Kajaani (FI); Atte Haataja, Kajaani (FI)

(73) Assignee: OMAVALMENTAJA KAJAANI OY, Kajaani (FI)

( * ) Notice: Subject to any disclaimer, the term of this patent is extended or adjusted under 35 U.S.C. 154(b) by 0 days.

(21) Appl. No.: 14/781,651

(22) PCT Filed: Apr. 22, 2015

(86) PCT No.: PCT/FI2015/050279

§ 371 (c)(1),
(2) Date: Oct. 1, 2015

(87) PCT Pub. No.: WO2015/166138

PCT Pub. Date: Nov. 5, 2015

(65) Prior Publication Data

US 2016/0129302 A1 May 12, 2016

(30) Foreign Application Priority Data

Apr. 28, 2014 (FI) ..... 20145392

(51) Int. Cl.
*A63B 21/00* (2006.01)
*A61H 1/00* (2006.01)
(Continued)

(52) U.S. Cl.
CPC ..... *A63B 22/20* (2013.01); *A61H 1/0292* (2013.01); *A61H 15/00* (2013.01);
(Continued)

(58) Field of Classification Search
CPC .. A61H 1/0292; A61H 1/0266; A61H 1/0218; A61H 1/0222; A61H 1/0229;
(Continued)

(56) References Cited

U.S. PATENT DOCUMENTS 581,835 A * 5/1897 Sturgis ..... A63B 69/16 482/61
604,200 A * 5/1898 Vogeler ..... A63B 69/16 482/61
(Continued)

FOREIGN PATENT DOCUMENTS

CN 201200762 3/2009
CN 203483792 3/2014
(Continued)

OTHER PUBLICATIONS

International Search Report dated Jul. 21, 2015, corresponding to PCT/FI2015/050279.
European Search Report EP15753299 dated Apr. 5, 2016.

*Primary Examiner* — Loan H Thanh
*Assistant Examiner* — Nyca T Nguyen
(74) *Attorney, Agent, or Firm* — Young & Thompson

(57) ABSTRACT

An massage device, includes a hollow cylindrical foam roller, two end plates fixable at the opposite ends of the roller, the inner envelope of the roller and the end plates essentially defining a cavity, and each of the end plates further including centrally situated bearing arrangement, two supporting feet each having a first and a second support, the first and the second support of the supporting feet are alignable at the end plates to set the supports at an angle relative to each other, and each of the supporting feet being fixable at the end plates of the roller by a fastening arrangement so that the supporting feet are at least functionally connected to the bearing arrangements of the associated end
(Continued)

plates and the roller is rotatably fixed to the supporting feet, and the supporting feet may be stored inside the cavity.

12 Claims, 5 Drawing Sheets

(51) Int. Cl.
*A61H 1/02* (2006.01)
*A63B 22/20* (2006.01)
*A61H 15/00* (2006.01)

(52) U.S. Cl.
CPC ..... *A61H 2015/0014* (2013.01); *A61H 2201/0119* (2013.01); *A61H 2201/0157* (2013.01); *A61H 2201/0161* (2013.01); *A61H 2201/1284* (2013.01); *A61H 2201/1454* (2013.01); *A61H 2201/1678* (2013.01); *A61H 2201/1685* (2013.01); *A61H 2201/1695* (2013.01); *A63B 2210/00* (2013.01)

(58) Field of Classification Search
CPC .... A61H 2015/0007; A61H 2015/0014; A61H 2015/006; A61H 2007/009; A61H 15/00; A61H 15/0085; A61H 15/0092; A61H 2015/0021; A61H 2015/0028; A61H 2015/0035; A61H 2015/0042; A61H 2015/005; A61H 2015/0057; A63B 21/00185; A63B 21/002; A63B 21/0023; A63B 21/22; A63B 21/4049; A63B 2213/00; A63B 22/20; A63B 22/0221; A63B 23/1218; A63B 23/1209; A63B 2069/167; A63B 2201/164; A63B 2201/1642; Y10T 403/32951; Y10T 403/32959
USPC ..... 472/127
See application file for complete search history.

(56) References Cited

U.S. PATENT DOCUMENTS 2,369,544 A * 2/1945 Dolan ..... A61H 15/00 482/79
3,106,395 A * 10/1963 Birkenbeul ..... A61H 15/00 482/132
3,845,952 A 11/1974 McKinney
3,905,597 A * 9/1975 Tabb ..... A63B 69/16 482/61
4,030,487 A * 6/1977 McEachran ..... 601/15
4,073,504 A * 2/1978 Knapp ..... A63B 26/003 280/205
4,893,813 A 1/1990 Murray
5,295,936 A * 3/1994 Perry, Jr. ..... A63B 21/00047 482/134
5,643,140 A * 7/1997 Tsai ..... A63B 22/0056 482/51
6,422,982 B1 7/2002 Retel
6,443,879 B1 * 9/2002 Chen ..... A61H 1/0218 482/143
6,857,992 B1 * 2/2005 Kolda ..... A63B 21/0051 482/61
8,033,964 B1 * 10/2011 Chen ..... A63B 21/00069 482/106
8,801,579 B2 * 8/2014 Beck ..... A63B 23/04 482/38
2006/0217237 A1 * 9/2006 Rhodes ..... A63B 21/225 482/61
2010/0022362 A1 1/2010 MacDonald
2010/0063429 A1 * 3/2010 McClorey ..... A61H 15/00 601/122
2011/0009248 A1 * 1/2011 Bronston ..... A63B 21/02 482/124
2011/0118095 A1 * 5/2011 Perry, Jr. ..... A61H 1/0218 482/142
2011/0183825 A1 * 7/2011 Yang ..... A63B 21/4039 482/132
2013/0096472 A1 4/2013 Bertram et al.
2015/0257969 A1 * 9/2015 Shannon ..... A61H 15/00 601/121
2015/0360071 A1 * 12/2015 Lee ..... A63B 21/012 482/116

FOREIGN PATENT DOCUMENTS

DE 1478019 10/1969
DE 2454924 7/1976
GB 424390 2/1935

* cited by examiner

EXERCISE ROLLER DEVICE WITH REMOVABLY FIXABLE SUPPORT

TECHNICAL FIELD

Generally, the invention relates to exercise and massage devices finding particular use in muscle maintenance and rehabilitation. The invention relates particularly to portable exercise devices.

BACKGROUND TECHNOLOGY

Muscle maintenance of athletes and persons in general comprises of all active and passive measures directed to accelerate a person's physical and mental recovery after physical exercise, to prevent acute and strain injuries, to attain an optimal relaxation and to enable a person to adopt an economic, efficient and an injury preventative way of exercising her body.

Various devices have been used as an aid to practice muscle maintenance. In particular, an approach advocated by many has been to roll one's back over a roller of various prescribed shapes while in a supine position. This method has the commendable goal of forced articulation of the vertebrae and stimulating the metabolism and stretching of exercised muscular groups and to massage the critical muscles, tendon, ligaments and articulations in a specific body region. While widely used and often portable, light and convenient, this category of exercise rollers finds a somewhat narrow field of application because of the limited exercise positions they provide, if an ergonomic exercise posture is to be maintained. This is true especially in case of exercise lower and upper extremities.

There exists various elevated and supported exercise devices containing one or more rollers or other rotatably or slideably mounted arrangements to direct a force or pressure to a specific body region with a similar goal as described above. While more versatile than a mere exercise roller, these exercise devices are often heavy fixedly placed equipment not meant to be portable and necessitating to reserve a considerable floor area for their placement, use and storage.

Other devices exist, which being either directed at a special or more versatile purpose, depend upon a separate operator of the device. In case of these devices, to receive the exercise or massage effect of the device, the person being object for the treatment at least partially relies on the actions of the one or more persons operating the device.

SUMMARY OF THE INVENTION

It is an object of the present invention to implement such a solution, that previously mentioned drawbacks of the prior art could be diminished. In particular, the invention discloses a device for exercise being at the same time portable and light, versatile and ergonomic and further operable by the user herself. A further object of the present invention is a device constituting of a roller within which the other parts constituting supporting feet can be stored for storage and transport, further this roller utilizable as ordinary rollers, and the support fixable rotatably to the roller by the user without any required tools yielding an elevated roller offering a versatile and ergonomic exercise device. Even further, the device according to the present invention is an exercise roller, that can be elevated to one or more heights from the supporting ground by fixing a first and a second support of the supporting feet to one or more predetermined relative angles. Utilizing supports of different lengths, adjustable for different lengths or having removable fixable sections, the roller can further be elevated at predetermined tilting angles to enable further exercise opportunities and positions in a user safe manner.

The objective of the invention is met by the features disclosed in the independent patent claim.

In accordance to one aspect of the present invention an exercise device, comprising:

a hollow cylindrical roller, two end plates fixable to the opposite ends of said roller, the inner envelope of the roller and the end plates essentially defining a cavity and each of the end plates further comprising essentially centrally situated bearing arrangement, two supporting feet each having a first and a second support wherein:

the first and the second support of the supporting feet are alignable at the end plates to set said supports at an angle relative to each other, and each of the supporting feet being fixable at their corresponding end of the roller by a fastening arrangement so that the supporting feet are at least functionally connected to the bearing arrangements of the associated end plates and the roller being rotatably fixed to or in relation the supporting feet.

According to an embodiment of the present invention the roller is rotatably fixed to or in relation to the supporting feet such that rotation in relation to said feet is possible. The roller may be rotatably fixed via the end plates fixed to the roller, which end plates may rotate around the bearing arrangement and the roller accordingly.

According to an embodiment of the present invention the cylindrical roller is essentially a tubular element that is suitable for exercise roller, foam roller and such form of exercising purposes. In other words, the cylindrical roller referred to herein may comprise a tubular or cylindrical element comprising one or more materials.

According to an embodiment of the present invention the end plates may constitute plates or similar structures. Further said plates may be of any size in relation to the inner envelope (geometry) of the roller. Preferably they are however such that they or their adverse surfaces (when fixed to the roller) seal the envelope to essentially constitute a closed cavity. However, the cavity may be also partially open from the sides of the end plates.

According to an embodiment of the present invention the end plates may comprise openings in communication with the radially innermost surface of the bearing arrangement.

According to an embodiment or the present invention the supports may be alignable to a predefined angle, such as at one or more predefined angles, relative to each other. According to another embodiment the supports may be alignable to practically any angle in the structural/physical limitations of the device to allow for essentially stepless adjustment and selection of the angle. Such may be done with e.g. by having a friction joint arrangement between the supports.

According to an embodiment of the present invention the fastening arrangement with which the supporting feet are fixable at the ends of the roller may attach to the radially innermost surface of the bearing arrangement of the associated end plate.

According to an embodiment of the present invention the supporting feet are at least functionally connected to the bearing arrangements of the associated end plates and the roller being rotatably fixed to the supporting feet and fastening arrangements by the mediation of the bearing arrangements of the associated end plate.

According to an embodiment of the present invention at least one of the end plates of the device may be removably fixed to the roller to allow access to the cavity and the dimensions of the supports, which are chosen in relation to said cavity, to allow upon removal of the fastening arrangements and said at least one end plate to insert said supports within the cavity for e.g. storage or transport.

According to an embodiment of the present invention the radially innermost surface of the bearing arrangement is the inner surface of a hollow tube connecting the two associated end plates.

According to another embodiment of the present invention the radially innermost surface of the bearing arrangement is the outer surface of a shaft connecting the two associated end plates.

According to yet another embodiment of the present invention the radially innermost surface of the bearing arrangement is a surface of the innermost part of a concentric bearing confined in the associated end plate.

According to an embodiment of the present invention the fastening arrangement may be operable by a user directing a rotating or translating force at the fastening arrangement in one direction to shorten a relative distance between a first and a second part of said fastening arrangement causing compression of length and expansion of width of an elastic member residing between said first and second part. Further the rotating or translating force at the fastening arrangement in the one direction causes fixing of the fastening device relative to the radially innermost surface of the bearing arrangement by friction between the expanded elastic member and the radially innermost surface of the bearing arrangement and further fixing the supporting foot at its corresponding end of the roller by said fastening arrangement attaching to the radially innermost surface of the bearing arrangement of the associated end plate. Further a rotating or translating force at the fastening arrangement in an opposite direction causes releasing of the fastening device and the supporting foot from the radially innermost surface of the bearing arrangement.

According to an embodiment of the present invention the fastening arrangement is operable by user by rotating a hand wheel of the fastening arrangement, the fastening arrangement further having a threaded portion. The threaded portion may be corresponding to an inter-relating threaded section at the radially innermost surface of the bearing arrangement, wherein the rotation of the fastening arrangement in one direction causing the fastening arrangement to thread in to the inter-relating threads to further fix the supporting foot at its corresponding end of the roller by said fastening arrangement attaching to the radially innermost surface of the bearing arrangement of the associated end plate and a rotation in an opposite direction causing the fastening arrangement to thread out of the inter-relating threads and releasing the supporting foot from the radially innermost surface of the bearing arrangement.

According to an embodiment of the present invention the fastening arrangement one or more of the supports may have a length different from another support. Further the supports may have removably fixable sections to allow for different lengths by fixing or removing of said sections or slidable extension arrangement to allow adjusting the length of the support.

According to an embodiment of the present invention fixing the first and the second support of the supporting feet to the end plate bearing arrangements with the fastening arrangements, said one or more of the supports having a length different from another support causing the roller to be aligned at a tilting angle relative to the supporting ground.

Some other preferable embodiments of the invention are described in the dependent claims.

Significant advantages can be achieved with the present invention when compared to the prior art solutions as a device is disclosed, being light and portable, user assemblable and operable, offering various exercise and massaging options applicable for various body regions not attainable with known devices of similar size, portability and operability.

SHORT DESCRIPTION OF THE DRAWINGS

Next, the invention is described in more detail with reference to the appended drawings, in which FIG. 1 illustrates one embodiment of the assembled apparatus according to the present invention in three exemplary positions.

DETAILED DESCRIPTION OF THE EMBODIMENTS

The device according to the present invention will now be discussed in further detail by disclosing non-limiting embodiments for illustrative purposes with appropriate references to the appended drawings.

The supporting feet of the exercise roller device according to the present invention are removably fixable at corresponding receiving end plates of the roller, the roller in rotatable connection to the feet by the mediation of the bearing arrangements of the end plates.

The bearing arrangement of the exercise roller device according to the present invention may utilize one or more elements that bear the roller relative to the supporting feet by the mediation of the fastening arrangement and constrain relative motion and reduce friction between moving parts to only the desired motion, the desired motion being free rotation of the roller around a fixed axis relative to its supporting feet, further determined by the fastening arrangement and centrally situated bearing arrangement and the opening in communication with a radially innermost surface of the bearing arrangement. According to the present invention, the fastening arrangement fixes essentially at the proximity of this radially innermost surface of the bearing arrangement.

The bearing arrangement construction may include a ball bearing, a roller bearing, a plain bearing, bearing surfaces, cut or formed into a part, with varying degrees of control over the form, size, roughness and location of the surface etc.

Figure 1:
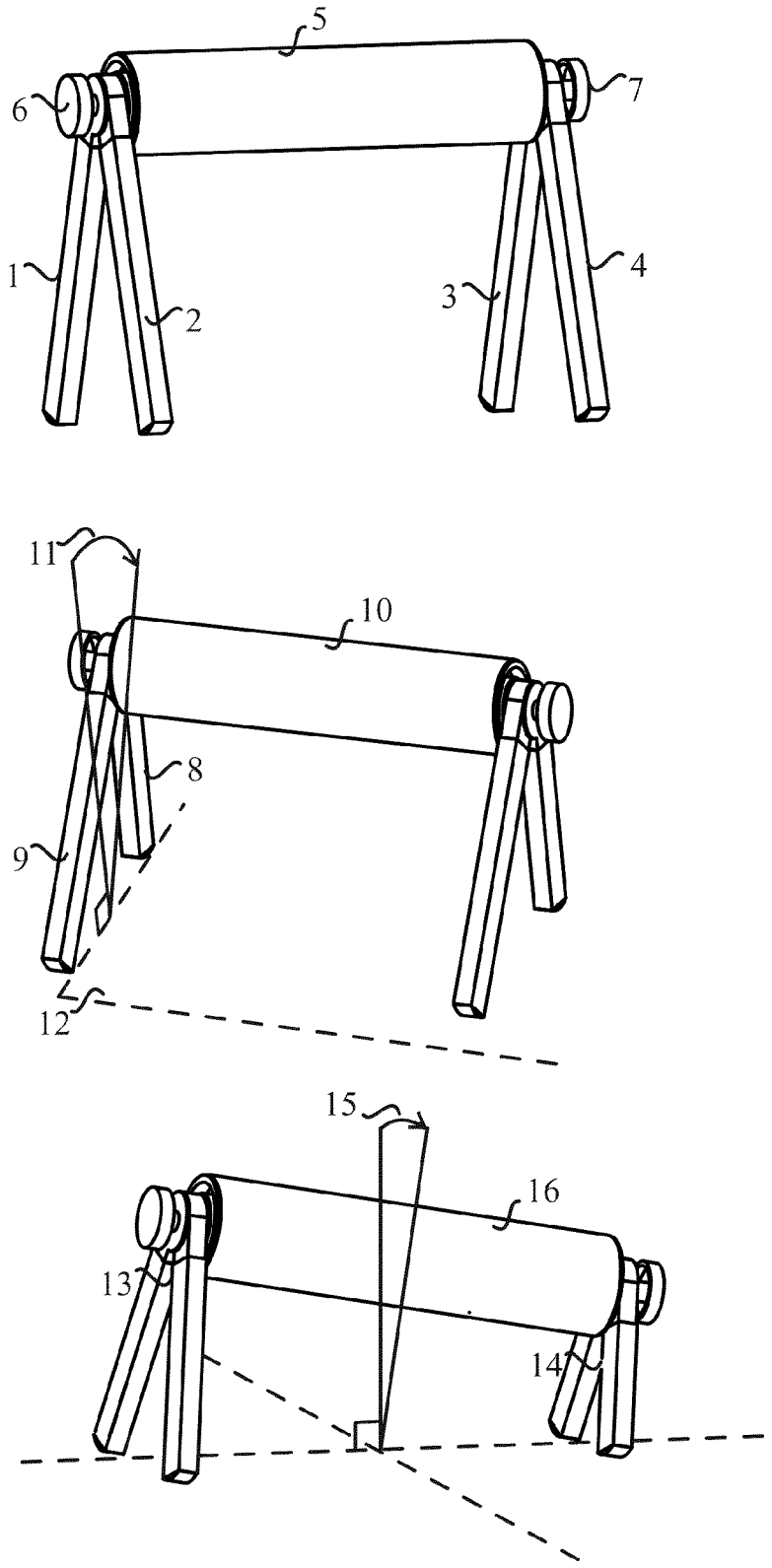

FIG. 1 illustrates one embodiment of the present invention, where two supporting feet each have two supports 1, 2 and 3, 4. The roller 5 is elevated by these supports from the supporting ground. According to one aspect of the invention, the roller is removably fixed to the supports constituting the two feet by a fastening arrangement of which FIG. 1 shows the visible thumb wheels 6, 7 which are user operable to fix or remove the feet from the roller. According to one further aspect of the invention, the fastening arrangement sets the supports relative to each other and further to the roller in such way that the roller may rotate relative to the supporting feet.

According to a further embodiment of the device according to the invention, the first support 8 of the supporting foot may have a length different from the second support 9 of that foot. The supports can be of different lengths or yielded to differ in length by using removably fixable sections or a slidable extension arrangement to allow adjusting the length of the support. The roller support feet fixed to the roller 10 according to such an embodiment has a leaning or tilting angle 11 relative the supporting ground 12. Further, for a roller 16, utilizing supports of a supporting foot 13 having a different length relative to the supports of the opposite supporting foot 14 may yield a leaning or tilting angle 15 perpendicular to the plane spanned by the angle 11. According to yet another aspect of the present invention, utilizing one or more lengths for the supports of the two supporting feet of the roller, an elevation height from and leaning angle relative to the supporting ground may be achieved, where the leaning angle can be any desired vector combination of said two angles 11 and 15.

Figure 2:
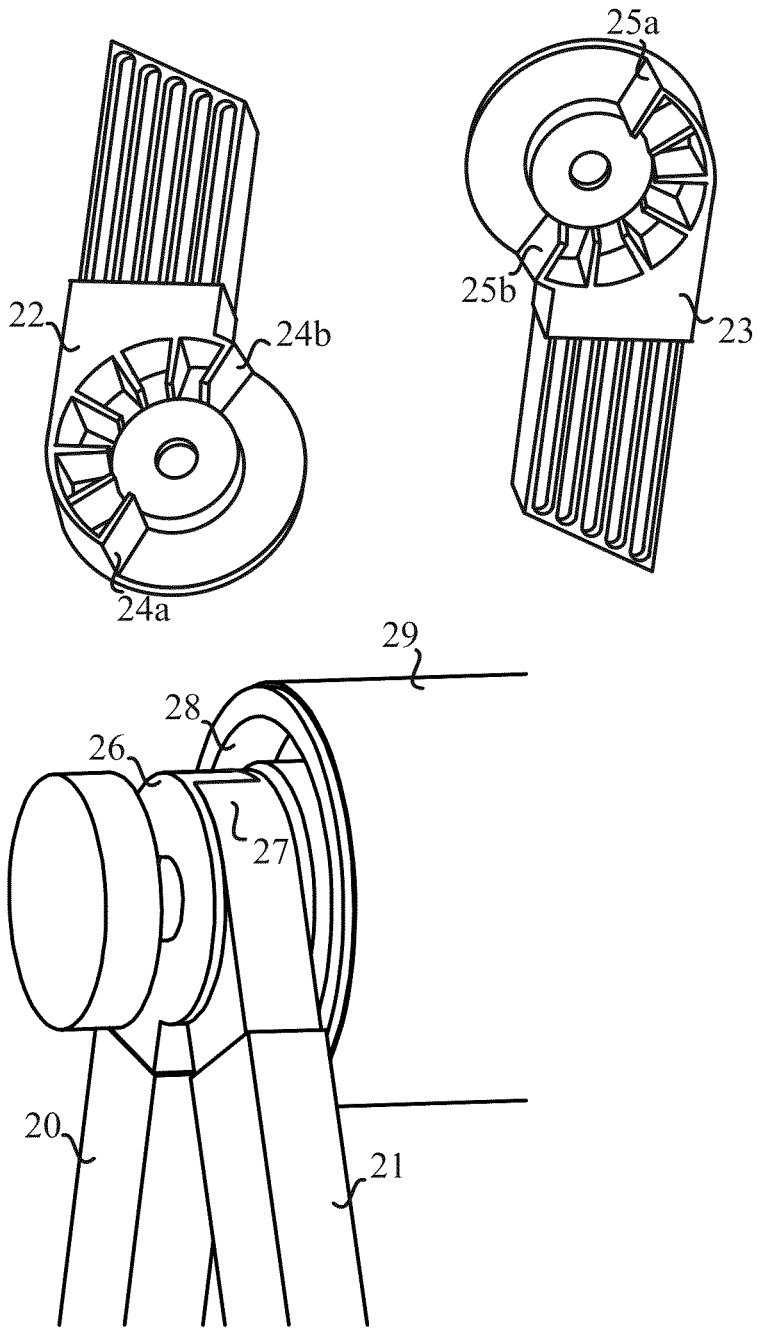
FIG. 2 illustrates details of one further embodiment of the apparatus according to the present invention.

FIG. 2 shows a fixed support pair 20, 21 and an embodiment 22, 23 of the upper part 27, 28 of the supports. According to one aspect of the invention, the support foot shown in FIG. 2, the supports 20, 21 are alignable by receiving surfaces 24*a*, 25*a* and 24*b*, 25*b* residing at their ends 26, 27 and shown in embodiment 22, 23, to form a supporting foot. The supporting foot is removably fixable at the corresponding receiving end plate 28 of the roller 29, the roller in rotatable connection to the foot by the mediation of the bearing arrangement of the end plate, of which embodiments will be illustrated in FIG. 4 and FIG. 5.

Further, the supports 20, 21 may comprise different alignment means from the depicted alignment surfaces 24*a*, 25*a*, 24*b*, 25*b*. For example, the joining surfaces of the supports 20, 21 could have structures and shapes, such as corrugation, spines, or other such shapes, which would make the supports 20, 21 attach in one or more essentially predefined angles. However, such shapes are not exclusive and the joining surfaces could be also essentially planar wherein the supports 20, 21 are attached in essentially any angle by friction from tightening the supports in to each other by the fastening arrangement.

Figure 3:
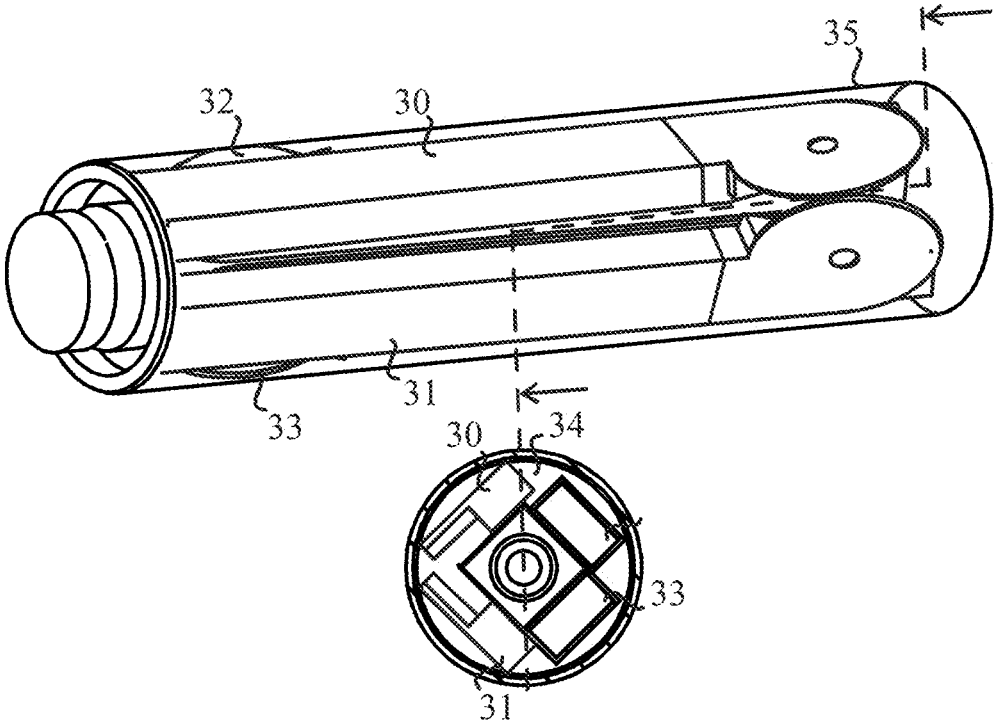
FIG. 3 illustrates one further embodiment of the disassembled apparatus according to the present invention.

FIG. 3 illustrates the device according to the present invention and embodiments thereof, wherein upon removing supporting feet by operating the fastening arrangements and removing one of the end plates, the supports 30, 31, 32, 33 are inserted within the cavity 34 of the roller 35, for storage or transport.

Figure 4:
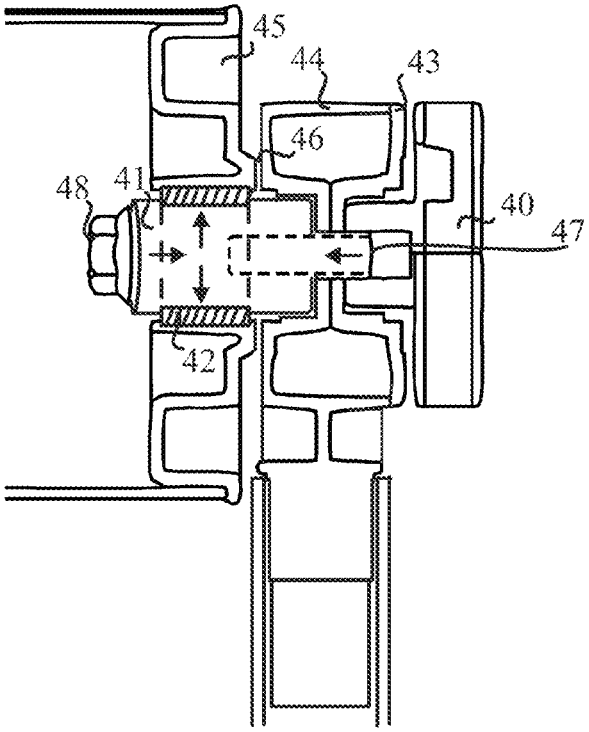
FIG. 4 illustrates one embodiment of a fastening arrangement of the assembled apparatus according to the present invention.

In FIG. 4 according to one aspect of the invention, the fastening arrangement comprising a first part 47 and a second part 48 is operable by the user, by rotating a thumb wheel 40 to simultaneously compress an elastic friction member 41 to expand and fix against the inner surface of the bearing arrangement 42 and to pull together the first and second support 43, 44 fixing them relative to the fastening arrangement at the end plate 45, the radially innermost surface of the bearing arrangement being a surface of the innermost part of a concentric bearing 42 confined in the associated end plate 45. The corresponding surfaces of the support 44 and the end plate 45 may be in sliding contact as bearing surfaces at the boundary 46 or a plain bearing etc. may be utilized at the boundary 46, between the support and the end plate.

Figure 5:
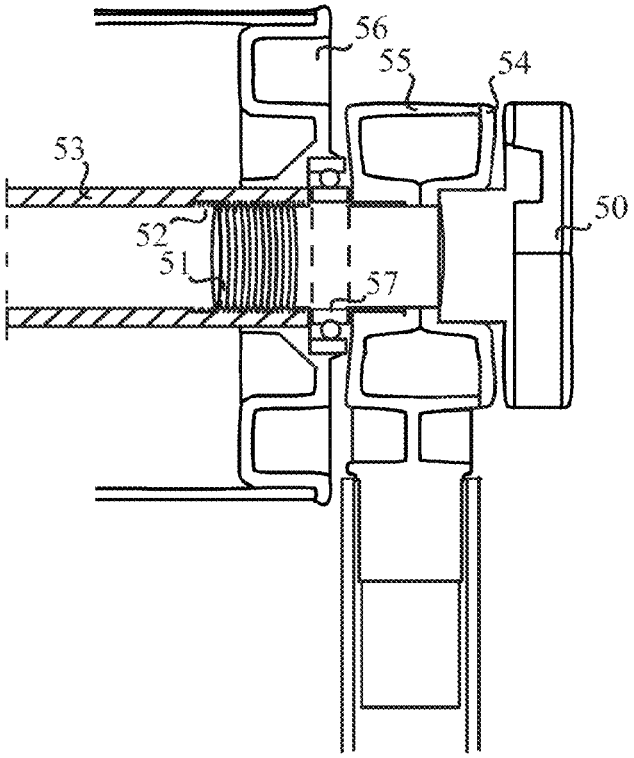
FIG. 5 illustrates one further embodiment of a fastening arrangement of the assembled apparatus according to the present invention.

In FIG. 5 according to one further aspect of the invention, the fastening arrangement is operable by the user, by rotating a thumb wheel 50 of the fastening arrangement, the fastening arrangement further having a threaded portion 51 corresponding to an inter-relating threaded section 52 at the radially innermost surface of the bearing arrangement being a hollow tube 53, the radially innermost surface of the bearing arrangement being the inner surface of the hollow tube. The rotation of the fastening arrangement causes the fastening arrangement to thread in to the tube threads to pull together the first and second support 54, 55 and the end of the tube 53, and may further utilize a ball bearing 57 etc. between the support 55 and the end of the tube 53 against which the first and second support 54, 55 on one side and the end of the tube 53 on the opposite side of the bearing 57 are pulled.

The threaded section and the inter-relating threaded section thereof may be implemented as illustrated in FIG. 5, the fastening arrangement having an outer threaded section (male thread) and the radially innermost surface of the bearing arrangement having an inner thread (female thread). Even further according to one further aspect of the invention, the threads may be reversed, so that the fastening arrangement has a hollow section with inner threads and an inter-relating threaded section at the radially innermost surface of the bearing arrangement being an outer thread on the outer surface of a shaft, rod, tube etc. connecting the two end plates.

Figure 6:
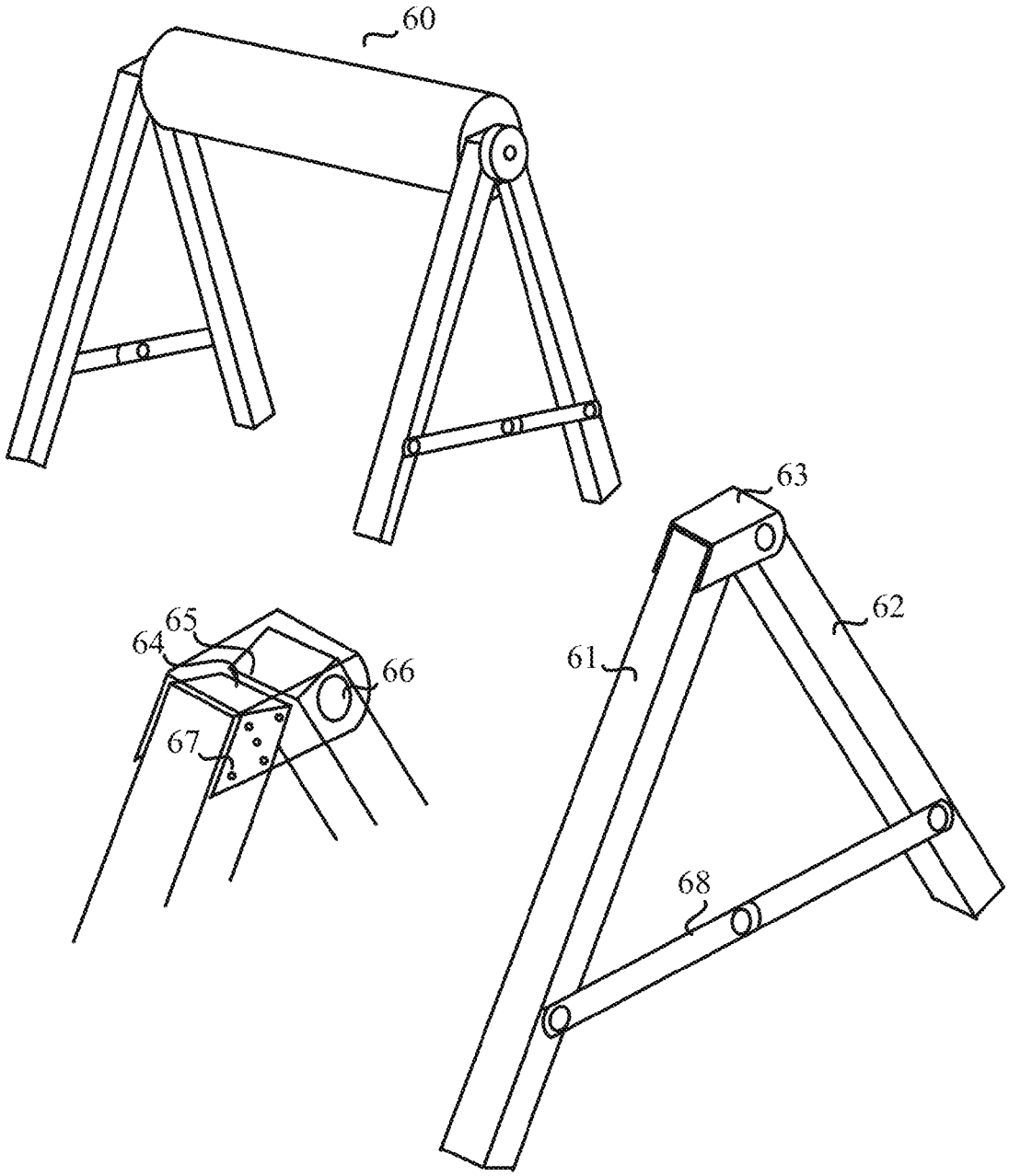
FIG. 6 illustrates one further embodiment and details thereof of the assembled apparatus according to the present invention.

According to another embodiment of the invention in FIG. 6 the device 60 has two supporting feet, each having two supports 61, 62, the supports being foldably attached 63 at their one end having receiving surfaces 64, 65 residing at said one end and the attachment 63 being a clamp, hinge etc. and being further adapted to receive a bolt 66, fastening arrangement 67 etc. allowing the supports to be folded apart to one or more predefined angles to form a supporting foot and folded together for storage or transportation within the roller cavity. The supporting feet of the embodiment of FIG. 6 further has a linkage arrangement 68 to hold the support apart at one or more predefined angles.

The end plates and the supports may at least partially be constructed using glass or carbon fiber reinforced polyamides or nylon, polyoxymethylene etc. Parts of the supports, such as sections thereof, may be constructed using steel, aluminum etc. The bearing arrangements may use typical bearing construction and materials such as steel or suitable engineering plastics, such as mentioned above for example. The roller may be constructed using polyethylene, polypropylene etc. The roller may be covered either with a permanent covering or a changeable cover using for example Velcro-type attachment between the roller outer surface and covering inner surface. The used covering may be chosen for a desired elasticity or flexibility and may have raised, elevated, protruding, sunken or embedded patterns, ridges or sections on its outer surface to yield location or direction dependent variation to the pressure applied to a treated body section and parts thereof.

The scope of the invention is determined by the attached claims together with the equivalents thereof. The skilled persons will again appreciate the fact that the explicitly disclosed embodiments were constructed for illustrative purposes only, and the scope will cover further embodiments, embodiment combinations and equivalents that better suit each particular use case of the invention.

The invention claimed is:

1. A massaging device, comprising:

a hollow cylindrical foam roller with an inner envelope and two opposite ends, two end plates respectively fixable to the two opposite ends of said roller, wherein at least one of the end plates is removably fixed to the respective end of said roller, the inner envelope of the roller and the end plates essentially defining a cavity and each of the end plates further comprising an essentially centrally situated bearing arrangement, and two supporting feet, each said supporting foot having a first and a second support wherein:

the first and the second support of the supporting feet are alignable at the end plates to set said first and second supports at an angle relative to each other, and each of the supporting feet being removably fixable at their corresponding end of the roller by a fastening arrangement so that the supporting feet are at least functionally connected to the bearing arrangements of the associated end plates and the roller being rotatably fixed to or in relation to the supporting feet and wherein the cavity is configured for the supporting feet to be stored inside said cavity.

2. The device according to claim 1, wherein, one or more of the supports has a length different from another of the supports and the one or more of the supports has removably fixable sections to allow for different lengths by fixing or removing of said sections.

3. The device according to claim 2, wherein, fixing the first and the second support of the supporting feet to the end plate bearing arrangements with the fastening arrangements, said one or more of the supports having a length different from another support causes the roller to be aligned at a tilting angle relative to supporting ground.

4. The device according to claim 1, further wherein:

at least one of the end plates being removably fixed to the roller allows access to the cavity, and dimensions of the supports in relation to said cavity allow, upon removal of the fastening arrangements and said at least one end plate, allowing insertion of said supports within the cavity for storage or transport.

5. The device according to claim 1, wherein a radially innermost surface of the bearing arrangement is the inner surface of a hollow tube connecting the two end plates.

6. The device according to claim 1, wherein a radially innermost surface of the bearing arrangement is an outer surface of a shaft connecting the two end plates.

7. The device according to claim 1, wherein a radially innermost surface of the bearing arrangement is a surface of an innermost part of a concentric bearing confined in the end plates.

8. The device according to claim 1, wherein, the fastening arrangement is operable by a user directing a rotating or translating force at the fastening arrangement in one direction to shorten a relative distance between a first and a second part of said fastening arrangement causing compression of length and expansion of width of an expandable elastic member residing between said first and second part, the rotating or translating force at the fastening arrangement in said one direction fixing the fastening arrangement relative to a radially innermost surface of the bearing arrangement by friction between the expandable elastic member and the radially innermost surface of the bearing arrangement and further fixing the supporting foot at a corresponding end of the roller by said fastening arrangement attaching to the radially innermost surface of the bearing arrangement of the associated end plate, and a rotating or translating force at the fastening arrangement in an opposite direction releasing the fastening arrangement and the supporting foot from the radially innermost surface of the bearing arrangement.

9. The device according to claim 1, wherein, the fastening arrangement is operable by a user by rotating a hand wheel of the fastening arrangement, the fastening arrangement further having a threaded portion corresponding to an inter-relating threaded section at a radially innermost surface of the bearing arrangement, the rotation of the fastening arrangement in one direction causing the fastening arrangement to thread in to the inter-relating threads to further fix the supporting foot at a corresponding end of the roller by said fastening arrangement attaching to the radially innermost surface of the bearing arrangement of the associated end plate, and a rotation in an opposite direction causing the fastening arrangement to thread out of the inter-relating threads and releasing the supporting foot from the radially innermost surface of the bearing arrangement.

10. An exercising device, comprising:

a hollow cylindrical roller with an inner envelope and two opposite ends;

two end plates respectively fixable to the two opposite ends of said roller, the inner envelope of the roller and the end plates essentially defining a cavity, each of the end plates further comprising an essentially centrally situated bearing arrangement; and two supporting feet, each said supporting foot having a first and a second support, wherein, the first and the second support are alignable at the end plates to set said first and second supports at an angle relative to each other, each of the supporting feet are removably fixable at corresponding ends of the roller by a fastening arrangement so that the supporting feet are at least functionally connected to the bearing arrangements of the associated end plates with the roller being rotatably fixed to or in relation to the supporting feet, the fastening arrangement is operable by a user directing a rotating or translating force at the fastening arrangement in one direction to shorten a relative distance between a first and a second part of said fastening arrangement causing compression of length and expansion of width of an expandable elastic member residing between said first and second part, the rotating or translating force at the fastening arrangement in said one direction fixing the fastening arrangement relative to a radially innermost surface of the bearing arrangement by friction between the expandable elastic member and the radially innermost surface of the bearing arrangement and further fixing the supporting foot at a corresponding end of the roller by said fastening arrangement attaching to the radially innermost surface of the bearing arrangement of the associated end plate, and a rotating or translating force at the fastening arrangement in an opposite direction releasing the fastening arrangement and the supporting foot from the radially innermost surface of the bearing arrangement.

11. The device according to claim 10, wherein at least one of the end plates is removably fixed to the roller allows access to the cavity for storage of the supporting feet, and dimensions of the supports in relation to said cavity allow, upon removal of the fastening arrangements and said at least one end plate, allow insertion of said supports within the cavity for storage or transport.

12. The device according to claim 10, wherein the radially innermost surface of the bearing arrangement is a surface of an innermost part of a concentric bearing confined in the end plates.

* * * * *